US010707571B2

(12) United States Patent
Wu

(10) Patent No.: US 10,707,571 B2
(45) **Date of Patent: *Jul. 7, 2020**

(54) ANTENNA DEVICE FOR MOBILE TERMINAL AND MOBILE TERMINAL

(71) Applicant: GUANGDONG OPPO MOBILE TELECOMMUNICATIONS CORP., LTD., Dongguan, Guangdong (CN)

(72) Inventor: Qing Wu, Guangdong (CN)

(73) Assignee: GUANGDONG OPPO MOBILE TELECOMMUNICATIONS CORP., LTD., Dongguan, Guangdong (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/393,265

(22) Filed: Apr. 24, 2019

(65) Prior Publication Data

US 2019/0252773 A1 Aug. 15, 2019

Related U.S. Application Data

(63) Continuation of application No. 15/668,778, filed on Aug. 4, 2017, now Pat. No. 10,312,585.

(30) Foreign Application Priority Data

Nov. 18, 2016 (CN) ..... 2016 1 1036734
Nov. 18, 2016 (CN) ..... 2016 2 1257004 U

(51) Int. Cl.

| | |
|---|---|
| ***H01Q 1/24*** | (2006.01) |
| ***H01Q 1/52*** | (2006.01) |
| ***H01Q 1/48*** | (2006.01) |
| ***H01Q 9/04*** | (2006.01) |

(52) U.S. Cl.

CPC ..... *H01Q 1/528* (2013.01); *H01Q 1/24* (2013.01); *H01Q 1/242* (2013.01); *H01Q 1/48* (2013.01); *H01Q 9/0442* (2013.01)

(58) Field of Classification Search

CPC ..... H01Q 1/528; H01Q 1/48; H01Q 1/242; H01Q 1/24; H01Q 9/0442

(Continued)

(56) References Cited

U.S. PATENT DOCUMENTS 8,000,738 B2 8/2011 Kang et al.
9,236,650 B2 * 1/2016 Kim ..... H01Q 1/243

(Continued)

FOREIGN PATENT DOCUMENTS

CN 201966972 9/2011
CN 104241870 12/2014

(Continued)

OTHER PUBLICATIONS

EPO, Office Action for EP Application No. 17184222, dated Feb. 13, 2018.

(Continued)

*Primary Examiner* — Jean B Jeanglaude
(74) *Attorney, Agent, or Firm* — Hodgson Russ LLP

(57) ABSTRACT

An antenna device for a mobile terminal as well as a mobile terminal is provided. The antenna device includes: a metal battery cover including a plurality of first ground points; a mainboard including a plurality of second ground points; a plurality of antennas coupled to the mainboard; a plurality of first connecting members coupling the plurality of first ground points to the plurality of second ground points; and a plurality of first capacitors coupled between the plurality of first connecting members and the plurality of first ground points respectively.

20 Claims, 4 Drawing Sheets

(58) Field of Classification Search
USPC ..... 343/702
See application file for complete search history.

(56) References Cited

U.S. PATENT DOCUMENTS

| | | | | |
|---|---|---|---|---|
| 9,431,693 | B2 * | 8/2016 | Kwak | H01Q 1/243 |
| 9,905,935 | B2 * | 2/2018 | Iso | H01Q 1/246 |
| 2006/0066490 | A1 * | 3/2006 | Ku | H01Q 1/243 343/702 |
| 2010/0149051 | A1 * | 6/2010 | Cho | H01Q 1/084 343/702 |
| 2016/0373650 | A1 | 12/2016 | Kim et al. | |

FOREIGN PATENT DOCUMENTS

| | | |
|---|---|---|
| CN | 104701619 | 6/2015 |
| CN | 205039252 | 2/2016 |
| CN | 205050981 | 2/2016 |
| CN | 106129616 | 11/2016 |
| CN | 106410373 | 2/2017 |
| CN | 206194946 | 5/2017 |
| EP | 1367803 | 12/2003 |
| EP | 3001649 | 3/2016 |
| JP | 2009194223 | 8/2009 |
| WO | 2012144197 | 10/2012 |
| WO | 2016154851 | 10/2016 |
| WO | 2016173490 | 11/2016 |

OTHER PUBLICATIONS

SIPO, First Office Action for CN Application No. 201611036734, dated Feb. 23, 2018.
WIPO, English translation of the ISR and WO for PCT/CN2017/095352, Oct. 23, 2017.

* cited by examiner

ANTENNA DEVICE FOR MOBILE TERMINAL AND MOBILE TERMINAL

CROSS-REFERENCE TO RELATED APPLICATIONS

This application is a continuation of U.S. application Ser. No. 15/668,778, filed Aug. 4, 2017, which claims priority to Chinese Patent Application No. 201611036734.0, filed Nov. 18, 2016, and priority to Chinese Patent Application No. 201621257004.9, filed Nov. 18, 2016. The entire disclosures of the aforementioned applications are incorporated herein by reference.

FIELD

The present disclosure relates to a field of mobile terminal manufacturing technology, and particularly, to an antenna device for a mobile terminal and a mobile terminal.

BACKGROUND

With the rapid development of the mobile terminal manufacturing technology and the increasingly high daily needs, more and more users expect the mobile terminal to have a more dazzling appearance to show their own personalities. A mobile terminal with a metal battery cover becomes more and more popular among the users due to its expressive appearance. However, conductivity of the metal battery cover causes secondary radiation, which may adversely affect the antenna performance. It is necessary to process the metal battery cover in order to effectively reduce a negative impact of the metal battery cover on the antenna. Therefore, an urgent problem to be solved is how to design or arrange the structural or positional relationship between the metal battery cover and the antenna so as to effectively address the negative impact of the metal battery cover on the antenna performance.

SUMMARY

A first objective of the present disclosure is to provide an antenna device for a mobile terminal. The antenna device includes: a metal battery cover including a plurality of first ground points; a mainboard including a plurality of second ground points; a plurality of antennas coupled to the mainboard; a plurality of first connecting members coupling the plurality of first ground points to the plurality of second ground points; and a plurality of first capacitors coupled between the plurality of first connecting members and the plurality of first ground points respectively.

A second objective of the present disclosure is to provide a mobile terminal. The mobile terminal includes an antenna device and a support structure. The antenna device includes a metal battery cover including a plurality of ground points; a mainboard including a ground wire coupled to the support structure; a plurality of antennas coupled to the mainboard; a plurality of connecting members coupling the plurality of ground points to the ground wire; and a plurality of capacitors coupled between the plurality of connecting members and the plurality of ground points respectively.

A third objective of the present disclosure is to provide another mobile terminal. The mobile terminal includes a metal battery cover including a plurality of first ground points and a plurality of second ground points; a mainboard including a plurality of third ground points and a ground wire, and defining a groove; a plurality of antennas coupled to the mainboard; a plurality of first connecting members coupling the plurality of first ground points to the plurality of third ground points; a plurality of first capacitors coupled between the plurality of first connecting members and the plurality of first ground points respectively; a plurality of second connecting members coupling the plurality of second ground points to the ground wire; and a plurality of second capacitors coupled between the plurality of second connecting members and the plurality of second ground points respectively; and a support structure coupled to the ground wire and located in the groove.

BRIEF DESCRIPTION OF THE DRAWINGS

These and/or other aspects and advantages of the present disclosure will become apparent and more readily appreciated from the following descriptions of embodiments made with reference to the drawings, in which.

DETAILED DESCRIPTION

Figure 1:
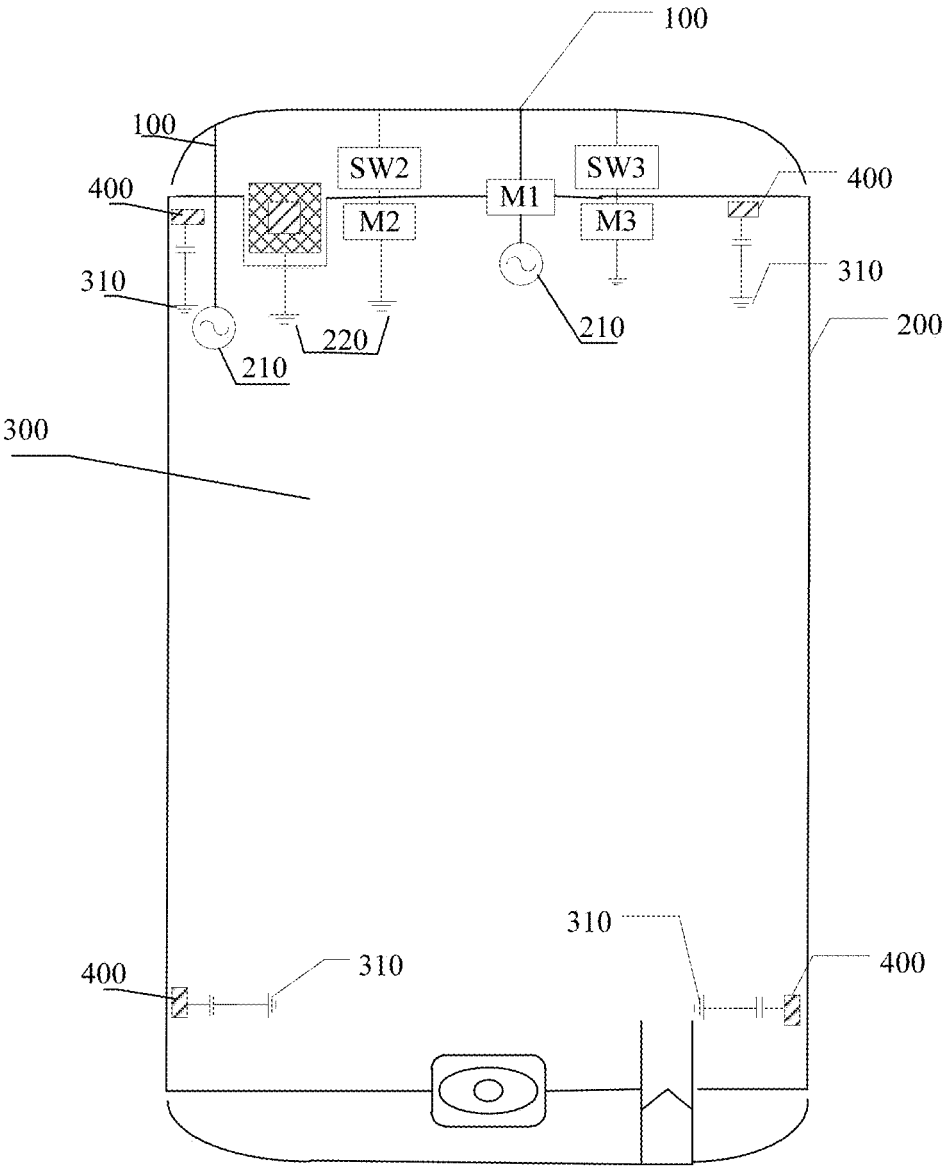
FIG. 1 is a schematic view of an antenna device for a mobile terminal according to an embodiment of the present disclosure.

Reference will be made in detail to embodiments of the present disclosure. Examples of the embodiments are illustrated in the drawings. The embodiments described herein with reference to drawings are explanatory, and used to interpret the present disclosure. The embodiments shall not be construed to limit the present disclosure.

The present disclosure provides an antenna device for a mobile terminal. The antenna device includes: a metal battery cover including a plurality of first ground points; a mainboard including a plurality of second ground points; a plurality of antennas coupled to the mainboard; a plurality of first connecting members coupling the plurality of first ground points to the plurality of second ground points; and a plurality of first capacitors coupled between the plurality of first connecting members and the plurality of first ground points respectively.

The present disclosure provides a mobile terminal. The mobile terminal includes an antenna device and a support structure. The antenna device includes a metal battery cover including a plurality of ground points; a mainboard including a ground wire coupled to the support structure; a plurality of antennas coupled to the mainboard; a plurality of connecting members coupling the plurality of ground points to the ground wire; and a plurality of capacitors coupled between the plurality of connecting members and the plurality of ground points respectively.

The present disclosure further provides another mobile terminal. The mobile terminal includes a metal battery cover including a plurality of first ground points and a plurality of second ground points; a mainboard including a plurality of third ground points and a ground wire, and defining a groove; a plurality of antennas coupled to the mainboard; a plurality of first connecting members coupling the plurality of first ground points to the plurality of third ground points; a plurality of first capacitors coupled between the plurality of first connecting members and the plurality of first ground points respectively; a plurality of second connecting members coupling the plurality of second ground points to the ground wire; and a plurality of second capacitors coupled between the plurality of second connecting members and the plurality of second ground points respectively; and a support structure coupled to the ground wire and located in the groove.

In the following, an antenna device for a mobile terminal as well as a mobile terminal according to embodiments of the present disclosure will be described with reference to the accompanying drawings.

FIG. 1 illustrates a schematic view of an antenna device for a mobile terminal according to an embodiment of the present disclosure. It should be noted that in embodiments of the present disclosure, the mobile terminal can be a mobile phone, a tablet computer, a palmtop, a personal digital assistant and other hardware devices having various operating systems.

FIG. 1 illustrates the antenna device according to embodiments of the present disclosure. The antenna device can include a plurality of antennas 100, a mainboard 200, a metal battery cover 300 and a plurality of first connecting members 400.

As illustrated in FIG. 1, the mainboard 200 can include a plurality of feed sources 210. The plurality of feed sources 210 may be coupled to the plurality of antennas 100 respectively, i.e. one antenna 100 can be coupled to one feed source 210. The feed source 210 is a primary radiator that excites a primary reflective surface and a secondary reflective surface of a surface antenna, and is a critical component for determining an electrical characteristic and a frequency band of the antenna 100 connected thereto. The feed source 210 is configured to radiate a radio frequency power from a feed line in a form of electromagnetic waves to the reflective surfaces or a lens, such that an appropriate field distribution can be produced around an aperture to form a desired sharp wave beam or shaped wave beam, and the power that leaks out from edges of the primary reflective surface, the secondary reflective surface or the lens can be made as small as possible, thereby achieving as high a gain as possible. That is, a main function of the feed source 210 is to collect an electromagnetic wave signal received by the antenna 100 coupled to the feed source 210, convert the collected electromagnetic wave signal into a signal voltage and supply it to a tuner, and polarize the received electromagnetic wave.

It should be noted that the antenna 100 can include but is not limited to one or more of a GPS antenna, a Wi-Fi antenna and a communication antenna. For example, the antenna 100 can be any of the GPS antenna, the Wi-Fi antenna or the communication antenna; for another example, the antenna 100 can be a two-in-one antenna composed of the GPS antenna and the Wi-Fi antenna; for still another example, the antenna 100 can be a two-in-one antenna composed of the GPS antenna and the communication antenna. In embodiments of the present disclosure, the communication antenna can be a cellular mobile communication antenna, for instance, an antenna for 2G/3G/4G communication.

The metal battery cover 300 can include a plurality of first ground points 310. Locations corresponding to the first ground points 310 are used for grounding, such that a purpose of grounding can be achieved when other components (like the feed source) of the mobile terminal are coupled to the first ground points 310.

The plurality of first connecting members 400 couple the plurality of first ground points 310 to a plurality of second ground points 220 of the mainboard 200, in which the plurality of second ground points 220 correspond to the plurality of feed sources 210 respectively. It should be noted that the correspondence between the plurality of second ground points 220 and the plurality of the feed sources 210 means that the plurality of second ground points 220 are adjacent to the plurality of the feed sources 210, i.e., one second ground point 220 is relatively adjacent to one feed source 210. Thus, it is possible to guarantee the grounding for lightning protection of the antenna coupled to the feed source.

In conclusion, by using a plurality of areas of the metal battery cover as the ground points, and connecting the ground points with each other through the connecting members, the impact of the metal battery cover on antenna performance can be reduced effectively.

It could be understood that the number of the first ground points 310 can be more than one, such as two, four or eight. As an example, four first ground points 310 may be provided at four corner areas of the metal battery cover 300 respectively, that is, one first ground point may be situated at one corner area of the metal battery cover 300. In this example, when four first ground points 310 are provided, four first connecting members 400 can be provided to connect the first ground points 310 with the second ground points 220. For example, as illustrated in FIG. 1, each corner of the metal battery cover 300 is provided with one first ground point 310, and the first connecting member 400 for connecting the first ground point 310 with the second ground point 220 is also provided in each of the four corner areas of the metal battery cover 300. Thus, locations at the four corner areas of the metal battery cover can be used as the ground points, and the ground points can be connected with each other through the connecting members, which can eliminate or alleviate the impact of the metal battery cover on the antenna performance effectively.

Figure 2:
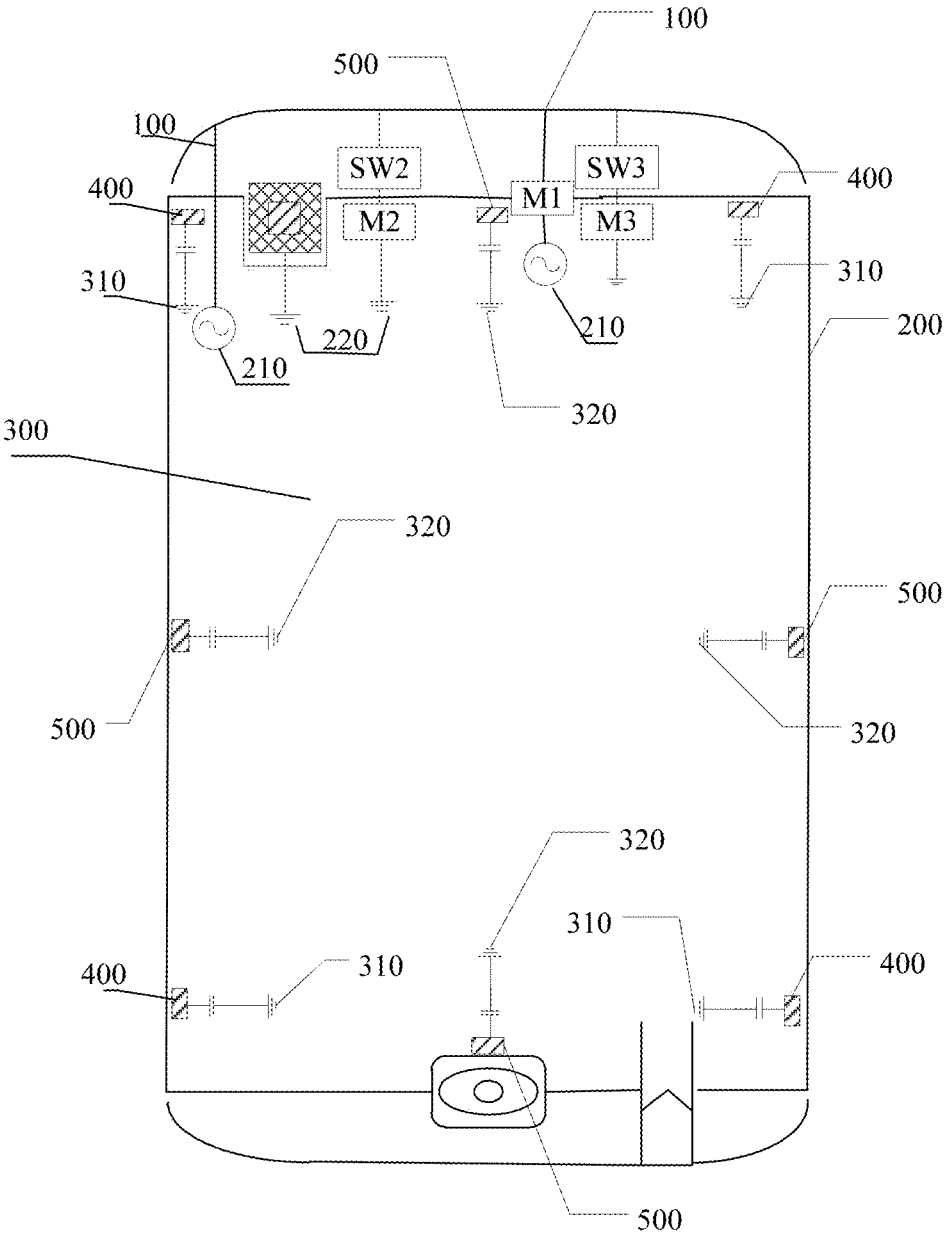
FIG. 2 is a schematic view of an antenna device for a mobile terminal according to another embodiment of the present disclosure.

To further reduce the impact of the metal battery cover on the antenna performance, as an example, as illustrated in FIG. 2, the metal battery cover 300 can further include a plurality of third ground points 320. In this example, the antenna device can further include a plurality of second connecting members 500, and the plurality of second connecting members 500 can couple the plurality of third ground points 320 with a ground wire of the mainboard 200.

In an embodiment of the present disclosure, as illustrated in FIG. 2, four third ground points 320 can be provided. The metal battery cover 300 can have four sides, and the four third ground points 320 can be located at midpoints of the four sides respectively. That is, the midpoint of each side of the metal battery cover 300 is provided with one third ground point 320, and regarding each third ground point 320, one second connecting member 500 can be used to connect the third ground point 320 with the ground wire of the mainboard 200.

Therefore, by connecting the first ground point with the second ground point of the mainboard through the first connecting member and connecting the third ground point with the ground wire of the mainboard through the second connecting member, when the antenna 100 receives or transmits a signal, an excited current on a surface of the metal battery cover can quickly return to the ground wire of the mainboard through the first connecting member and the second connecting member, which can effectively avoid adverse effects on the antenna performance due to secondary radiation.

Figure 3:
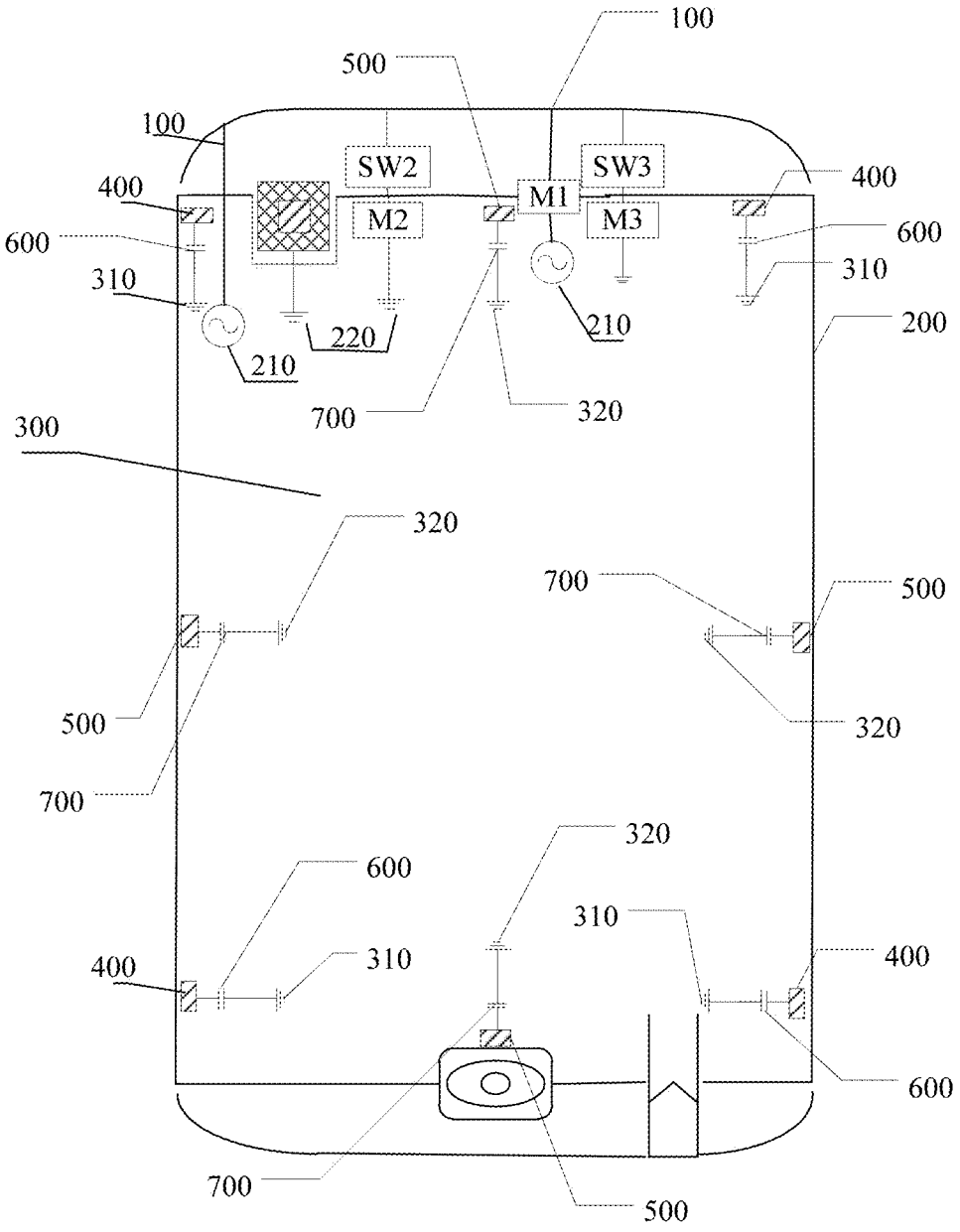
FIG. 3 is a schematic view of an antenna device for a mobile terminal according to still another embodiment of the present disclosure.

In order to effectively avoid problems (such as static electricity) caused by a charged battery cover due to a short circuit, as an example, as illustrated in FIG. 3, the antenna device can further include a plurality of first capacitors 600 and a plurality of second capacitors 700. The plurality of first capacitors 600 can be connected between the plurality of first connecting members 400 and the plurality of first ground points 310 respectively, and the plurality of second capacitors 700 can be connected between the plurality of second connecting members 500 and the plurality of third ground points 320 respectively. That is, one first capacitor 600 can be provided between one first connecting member 400 and one first ground point 310, and one second capacitor 700 can be provided between one second connecting member 500 and one third ground point 320. As such, a large capacitor is connected in series in a ground circuit and usually has a capacitance in the range of 80 PF~150 PF, as one implementation, around 100 PF, such that leakage during charging can be avoided on the one hand, thereby preventing leakage current from flowing into the metal battery cover and protecting a human in contact with the battery cover from getting an electric shock, and this capacitor is equivalent to a short circuit for a radio frequency signal and therefore does not affect the grounding of the metal battery cover on the other hand.

It could be understood that materials and structures of the first connecting member 400 and the second connecting member 500 can be various as long as they are electrically conductive. As an example, the first connecting member 400 and/or the second connecting member 500 can be resilient sheets, screws or pogo pin connectors, etc. Therefore, by utilizing the conductive property of the resilient sheets, screws or spring pin connectors, etc., the excited current on the metal battery cover can be conducted to the ground wire of the mainboard quickly, adverse effects on the antenna performance due to the secondary radiation of the metal battery cover can be effectively eliminated or alleviated.

In order to effectively avoid a problem of conductive failure between the connecting member and the ground point due to falling-off from a relatively low height, oxidation and other harsh circumstances, in an embodiment of the present disclosure, the antenna device can further include a plurality of first conductive fabrics and a plurality of second conductive fabrics. Each of the plurality of first conductive fabrics is located between each first ground point 310 and each corresponding first connecting member 400, and the each of the plurality of second conductive fabrics is located between each third ground point 320 and each corresponding second connecting member 500. In the embodiment of the present disclosure, the plurality of first conductive fabrics and the plurality of second conductive fabrics can be a plurality of gold-plated conductive fabrics or the like. Thus, by attaching the plurality of gold-plated conductive fabrics to a contact portion of the metal battery cover, it is possible to address a problem that the radio frequency impedance is too large due to poor contact caused by various harsh circumstances.

For the antenna device according to embodiments of the present disclosure, the plurality of first ground points are provided in the metal battery cover and the plurality of first ground points are connected with the plurality of second ground points of the mainboard through the plurality of first connecting members respectively, in which the plurality of second ground points correspond to the plurality of feed sources respectively. As such, a plurality of locations on the metal battery cover can be used as the ground points, and moreover, the ground points can be connected with each other through the connecting members, such that the excited current on the surface of the metal battery cover can quickly return to the ground wire of the mainboard through loops composed of the connecting members and the ground points, which can effectively reduce adverse effects on the antenna performance due to the secondary radiation.

It should be noted that a structure for the metal battery cover and the antenna in the antenna device according to embodiments of the present disclosure is applicable to designs including but not limited to a flexible printed circuit (FPC) antenna, a laser-direction-structuring (LDS) antenna, a metal middle-frame antenna, an all-metal battery cover antenna and so on.

In order to implement the above embodiments, a mobile terminal is also provided in the present disclosure.

Figure 4:
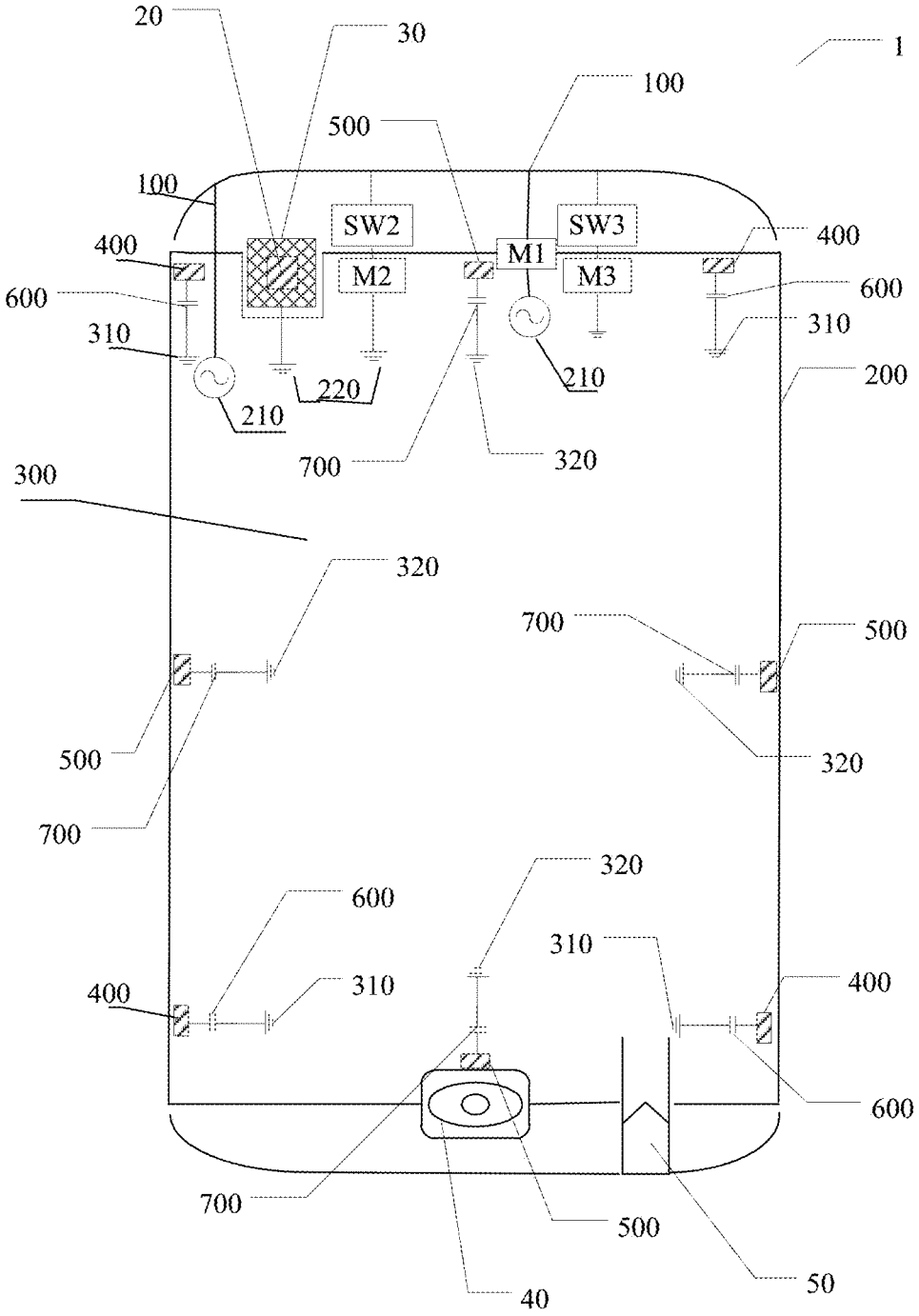
FIG. 4 is a schematic view of a mobile terminal according to an embodiment of the present disclosure.

FIG. 4 illustrates a schematic view of a mobile terminal according to an embodiment of the present disclosure. As illustrated in FIG. 4, the mobile terminal 1 can include an antenna device, a rear camera 20, a support structure 30, a front fingerprint module 40 and a headphone socket 50.

Detailed structures and functions of the antenna device can refer to the detailed description of that of the antenna device illustrated in FIGS. 1 to 3, and thus will not be elaborated herein.

As illustrated in FIG. 4, the rear camera 20 is embedded in the support structure 30, such that the support structure 30 can be configured to support the rear camera 20. The support structure 30 can be located in a groove of the mainboard and connected with the ground wire of the mainboard.

The front fingerprint module 40 can be located in a central lower part of a front surface of the mobile terminal 1 and configured to collect and identify a user's fingerprint. Thus, the user's fingerprint can be identified by the front fingerprint module, and various functions (such as unlocking of the mobile terminal, payment, and other functions) can be realized through the user's fingerprint.

The headphone socket 50 can be located in the bottom right of the mobile terminal 1. The headphone socket 50 is provided with a headphone jack into which a headphone can be inserted, and audio information transmission can be implemented through a sound track or a similar module in the headphone socket 50.

It could be understood that the above description only involves inventive components in the mobile terminal, and in addition to the above components, the mobile terminal can further include other components (such as a processor, a memory, a battery module etc.) to realize other functions, which will not be elaborated herein.

For the mobile terminal according to embodiments of the present disclosure, the plurality of first ground points are provided in the metal battery cover of the mobile terminal and the plurality of first ground points are coupled to the plurality of second ground points of the mainboard through the plurality of first connecting members, in which the plurality of second ground points correspond to the plurality of feed sources respectively. As such, the plurality of locations on the metal battery cover are configured as the ground points; moreover, the ground points can be connected with each other through the connecting members, such that the excited current on the surface of the metal battery cover can quickly return to the ground wire of the mainboard through loops composed of the connecting members and the ground points. Moreover, the large capacitor is connected in series in the ground circuit, such that the leakage can be avoided during the charging on the one hand, thereby preventing the leakage current from flowing to the metal battery cover and protecting the human in contact with the battery cover from getting the electric shock, and on the other hand, this capacitor is equivalent to a short circuit for the radio frequency signal and will not affect the grounding of the metal battery cover, thereby effectively avoiding adverse effects on the antenna performance due to the secondary radiation.

In the specification, it is to be understood that terms such as "central," "longitudinal," "transverse," "length," "width," "thickness," "upper," "lower," "front," "rear," "left," "right," "vertical," "horizontal," "top," "bottom," "inner," "outer," "clockwise," "counterclockwise," "axial," "radial" and "circumferential" should be construed to refer to the orientations or positions as described or as illustrated in the drawings under discussion. These relative terms are for convenience of description and do not indicate or imply that the device or element referred to must have a particular orientation or be constructed or operated in a particular orientation. Thus, the relative terms shall not be construed to limit the present disclosure.

In addition, terms such as "first" and "second" are used herein for purposes of description and are not intended to indicate or imply relative importance or significance or to imply the number of indicated technical features. Thus, the feature defined with "first" and "second" can comprise one or more of this feature. In the description of the present disclosure, the term "a plurality of" means two or more than two, unless specified otherwise.

In the present disclosure, unless specified or limited otherwise, the terms "mounted", "connected", "coupled", "fixed" and the like are used broadly, and can be, for example, fixed connections, detachable connections, or integral connections; can also be mechanical or electrical connections or communicated with each other; can also be direct connections or indirect connections via intervening structures; can also be inner communications or mutual interaction of two elements, which can be understood by those skilled in the art according to specific situations.

In the present disclosure, unless specified or limited otherwise, a structure in which a first feature is "on" or "below" a second feature can include an embodiment in which the first feature is in direct contact with the second feature, and can also include an embodiment in which the first feature and the second feature are not in direct contact with each other, but are contacted via an additional feature formed therebetween. Furthermore, a first feature "on," "above," or "on top of" a second feature can include an embodiment in which the first feature is right or obliquely "on," "above," or "on top of" the second feature, or just means that the first feature is at a height higher than that of the second feature; while a first feature "below," "under," or "on bottom of" a second feature can include an embodiment in which the first feature is right or obliquely "below," "under," or "on bottom of" the second feature, or just means that the first feature is at a height lower than that of the second feature.

Reference throughout this specification to "an embodiment", "some embodiments", "an example", "a specific example" or "some examples" means that a particular feature, structure, material, or characteristic described in connection with the embodiment or example is included in at least one embodiment or example of the present disclosure. Thus, the appearances of the above phrases throughout this specification are not necessarily referring to the same embodiment or example of the present disclosure. Furthermore, the particular features, structures, materials, or characteristics can be combined in any suitable manner in one or more embodiments or examples. Moreover, different embodiments or examples as well as the features in the different embodiments or examples described in the specification can be combined or united by those skilled in the related art in the absence of contradictory circumstances.

Although embodiments of the present disclosure have been shown and illustrated, it shall be understood by those skilled in the art that the above embodiments are explanatory and cannot be construed to limit the present disclosure, and changes, modifications, alternatives and variants can be made in the embodiments without departing from the scope of the present disclosure.

What is claimed is:

1. An antenna device for a mobile terminal, comprising:

a metal battery cover comprising a plurality of first ground points;

a mainboard comprising a plurality of second ground points;

a plurality of antennas coupled to the mainboard;

a plurality of first connecting members coupling the plurality of first ground points to the plurality of second ground points; and a plurality of first capacitors coupled between the plurality of first connecting members and the plurality of first ground points respectively.

2. The antenna device according to claim 1, wherein the metal battery cover further comprises a plurality of third ground points, the mainboard further comprises a ground wire, and the antenna device further comprises a plurality of second connecting members coupling the plurality of third ground points to the ground wire.

3. The antenna device according to claim 2, wherein each third ground point is located at a midpoint of a side of the metal battery cover.

4. The antenna device according to claim 1, wherein each first ground point is located at a corner area of the metal battery cover.

5. The antenna device according to claim 4, wherein each first connecting member is located at the corner area of the metal battery cover.

6. The antenna device according to claim 1, wherein each first capacitor has a capacitance in the range of 80 PF~150 PF.

7. The antenna device according to claim 2, further comprising a plurality of second capacitors coupled between the plurality of second connecting members and the plurality of third ground points respectively.

8. The antenna device according to claim 7, wherein each second capacitor has a capacitance in the range of 80 PF~150 PF.

9. The antenna device according to claim 1, wherein the plurality of antennas comprise one or more of a GPS antenna, a Wi-Fi antenna and a communication antenna.

10. The antenna device according to claim 2, wherein the plurality of first connecting members and the plurality of second connecting members are configured as conductive members.

11. The antenna device according to claim 10, wherein each first connecting member and each second connecting member are configured as a resilient sheet, a screw or a pogo pin connector.

12. The antenna device according to claim 2, further comprising a plurality of first conductive fabrics and a plurality of second conductive fabrics, each first conductive fabric being located between each first ground point and each corresponding first connecting member; and each second conductive fabric being located between each third ground point and each corresponding second connecting member.

13. The antenna device according to claim 12, wherein each first conductive fabric and each second conductive fabric are configured as a gold-plated conductive fabric.

14. A mobile terminal, comprising: an antenna device and a support structure, the antenna device comprising:

a metal battery cover comprising a plurality of ground points;

a mainboard comprising a ground wire coupled to the support structure;

a plurality of antennas coupled to the mainboard;

a plurality of connecting members coupling the plurality of ground points to the ground wire; and a plurality of capacitors coupled between the plurality of connecting members and the plurality of ground points respectively.

15. The mobile terminal according to claim 14, further comprising a rear camera, and the rear camera is embedded in the support structure.

16. The mobile terminal according to claim 14, wherein each capacitor has a capacitance in the range of 80 PF~150 PF.

17. The mobile terminal according to claim 14, wherein the mainboard has a groove and the support structure is located in the groove.

18. The mobile terminal according to claim 14, further comprising a front fingerprint module, the front fingerprint module is located in a central lower part of a front surface of the mobile terminal and configured to collect and identify a user's fingerprint.

19. The mobile terminal according to claim 14, further comprising a headphone socket, the headphone socket can be located in bottom right of the mobile terminal, and the headphone socket is provided with a headphone jack.

20. A mobile terminal, comprising:

a metal battery cover comprising a plurality of first ground points and a plurality of second ground points;

a mainboard comprising a plurality of third ground points and a ground wire, and defining a groove;

a plurality of antennas coupled to the mainboard;

a plurality of first connecting members coupling the plurality of first ground points to the plurality of third ground points;

a plurality of first capacitors coupled between the plurality of first connecting members and the plurality of first ground points respectively;

a plurality of second connecting members coupling the plurality of second ground points to the ground wire; and a plurality of second capacitors coupled between the plurality of second connecting members and the plurality of second ground points respectively; and a support structure coupled to the ground wire and located in the groove.

* * * * *